US005788589A

United States Patent [19]

Koo et al.

[11] Patent Number: 5,788,589

[45] Date of Patent: Aug. 4, 1998

[54] BATTING PRACTICE MACHINE FOR BASEBALL

[75] Inventors: Mun-Koing Koo, 103-1101 Chungku Apartment, Hansol Maeul, 110 Chungja-dong, Bungdang-ku, Sungnam-si, Kyungi-do; Hyeon-Yong Park, Seoul, both of Rep. of Korea

[73] Assignee: Mun-Koing Koo, Kyungki-do, Rep. of Korea

[21] Appl. No.: 856,123

[22] Filed: May 14, 1997

[51] Int. Cl.[6] ..... A63B 69/40

[52] U.S. Cl. ..... 473/429

[58] Field of Search ..... 473/429, 431, 473/436, 417

[56] References Cited

U.S. PATENT DOCUMENTS

| | | | |
|---|---|---|---|
| 4,105,203 | 8/1978 | Cho | 473/429 |
| 4,508,339 | 4/1985 | Llewellyn | 473/429 |
| 5,133,546 | 7/1992 | Vasquez | 473/429 |
| 5,618,039 | 4/1997 | Tsia | 473/436 |

*Primary Examiner*—Theatrice Brown

*Attorney, Agent, or Firm*—Darby & Darby

[57] ABSTRACT

The present invention relates to a batting practice machine for baseball which can repeatively practice batting technique to get a feel for push or pull-hitting the ball depending on its location, and satisfy the continuous practice of batting motion by rapidly return the ball to the batting point, as well as effectively preventing the from breakdown due to the impact on batting.

The present batting practice machine comprises a post supporting body 900 for supporting a lower post 800 vertically mounted on an upper surface of a base 950; an upper post 600 rotatable mounted on an upper end of the lower post 800; a transverse pivot shaft 500 rotatable with the upper post 600; a first restoring member 700 connecting the lower post to the transverse pivot shaft 500 for returning the transverse pivot shaft 500 to its initial position; damping member 300 provided to a front end of the transverse pivot shaft 500; a movable pipe 200 engaged to an end of the damping member 300; a rotating restrain rider 400 interposed between the transverse pivot shaft 500 and the movable pipe 400; and a front rotating body 100 secured to the front portion of the movable pipe 200 and having on an outer front end a pair of ball support 110.

6 Claims, 8 Drawing Sheets

BATTING PRACTICE MACHINE FOR BASEBALL

BACKGROUND OF THE INVENTION

1. Field of the Invention

The present invention relates to a batting practice machine for baseball, and more particularly to a batting practice machine for baseball which can repeatable practise batting technique to get a feel for push or pull-hitting the ball depending on its location, and satisfy the continuous practice of batting motion by rapidly returning the ball to the batting point, as well as effectively preventing the machine from breaking down due to the impact on batting.

2. Description of the Prior Art

In general, in baseball games batters have to have a command of the accurate batting motion capable of hitting a ball by the heart portion of a bat, and the feeling batting technique such as push or pull-hitting, depending on the ball's location. Accordingly, because it needs a lot of the repeatable practice for batting, there are proposed some batting practice machines.

Referring to FIG. 8 which illustrates a prior art batting practice machine for baseball, the center portion of a base 1 is engaged vertically with a post 2, and legs *1b* are fixed to the underside of the base by bolts *1a*. A transverse pivot shaft 3 is rotatable engaged to the upper end of the post 2, with the pivot shaft 3 being perpendicular to the post, and a rotating pipe 5 is rotatable engaged to one end of the transverse pivot shaft 3 through a rotating shaft 4. The other end of the transverse pivot shaft 3 is engaged to a bracket 8 extending from the post by means of a spring 9, such that the transverse pivot shaft 3 rotatable around the post 2 can be return to its initial position. Also, because a fixing rod 6 which each end is engaged with a ball 7 penetrates through the end of the rotating pipe 5 and is fixed thereto, when the ball 7 is hit, fixing rod 6 can be rotated around the rotating pipe 5 together with the ball 7.

However, it does not satisfy to practise variously the batting technique to get a feel for hitting the ball depending on its location by use of the prior art batting practice machine for baseball mentioned above. Particularly, it is possible to practise the motion of push-hitting because the fixing rod 6 to which ball 7 is engaged is rotated with the rotating pipe 5 when the ball 7 is hit. On pull-hitting along a constant trace on the center of hitter' body, however, the impact load provides excess tension stress in the axial direction the rotating pipe 5 and the transverse pivot shaft 3 which are engaged by the rotating shaft 4, which causes the connection of shafts to be destroyed and thus can not practise the pull-hitting.

Of course, although it may compensate the expected margin space for the moving width of the connection of shafts, it can not reduce the impact to be applied to the connection of shafts when the ball 7 which was moved to one side is hit again.

Also, because the positions of the upper and lower balls 7 which are rotated by rotating the fixing rod 6 according to the hitting force and the reacting force applied to the ball 7 can not return to the peak position capable of hitting and the transverse pivot shaft 3 rotatable around the post is severely vibrated from side to side by the resilient force of the spring 9, it is impossible to practise the batting safely and continuously.

In addition, it can not expect to have an practice effect of the variable and feeling batting technique depending on the location of the ball for lack of the machine capable of controlling the height of the ball.

SUMMARY OF THE INVENTION

In order to solve the problems involved in the prior art batting practice machine as mentioned above, a main object of the present invention is to provide the repeated practice of the batting technique to get a feel for push or pull-hitting the ball depending on the its location.

Another object of the present invention is to provide a batting practice machine for baseball which has an effect preventing the breakdown and the vibration from to be occurring, and executing satisfactorily the continuous practice of the batting motion by rapidly returning the upper and lower balls into the batting position.

In order to achieve the above objects, according to one aspect of the present invention, it provides a batting practice machine comprising: a post supporting body for supporting a lower post vertically mounted on an upper surface of a base; an upper post rotatable mounted on an upper end of the lower post; a transverse pivot shaft engaged to an upper portion of the upper post and rotatable with the upper post; a first restoring means connecting the lower post to the transverse pivot shaft for returning the transverse pivot shaft rotated around the lower post to its initial position; damping means provided to a front end of the transverse pivot shaft and therein having a damping pin with a pair of elastic means which is movably installed both sides of a center projection; a movable pipe engaged to an end of the damping pin and therein having a rotating shaft journalled by a bearing, which a portion of the rotating shaft protruding forwardly; a rotating restrain rider having one end secured to the transverse pivot shaft and the other end inserted to the movable pipe for restraining rotation of the movable pipe; and a front rotating body secured to the forward protruding portion of the rotating shaft and having on an outer front end a pair of ball support.

BRIEF DESCRIPTION OF THE DRAWINGS

The above objects, other aspects, and advantages of the invention will become apparent by describing the preferred embodiments thereof with reference to the accompanying drawings, in which.

DETAILED DESCRIPTION OF THE PREFERRED EMBODIMENT

Figure 1:
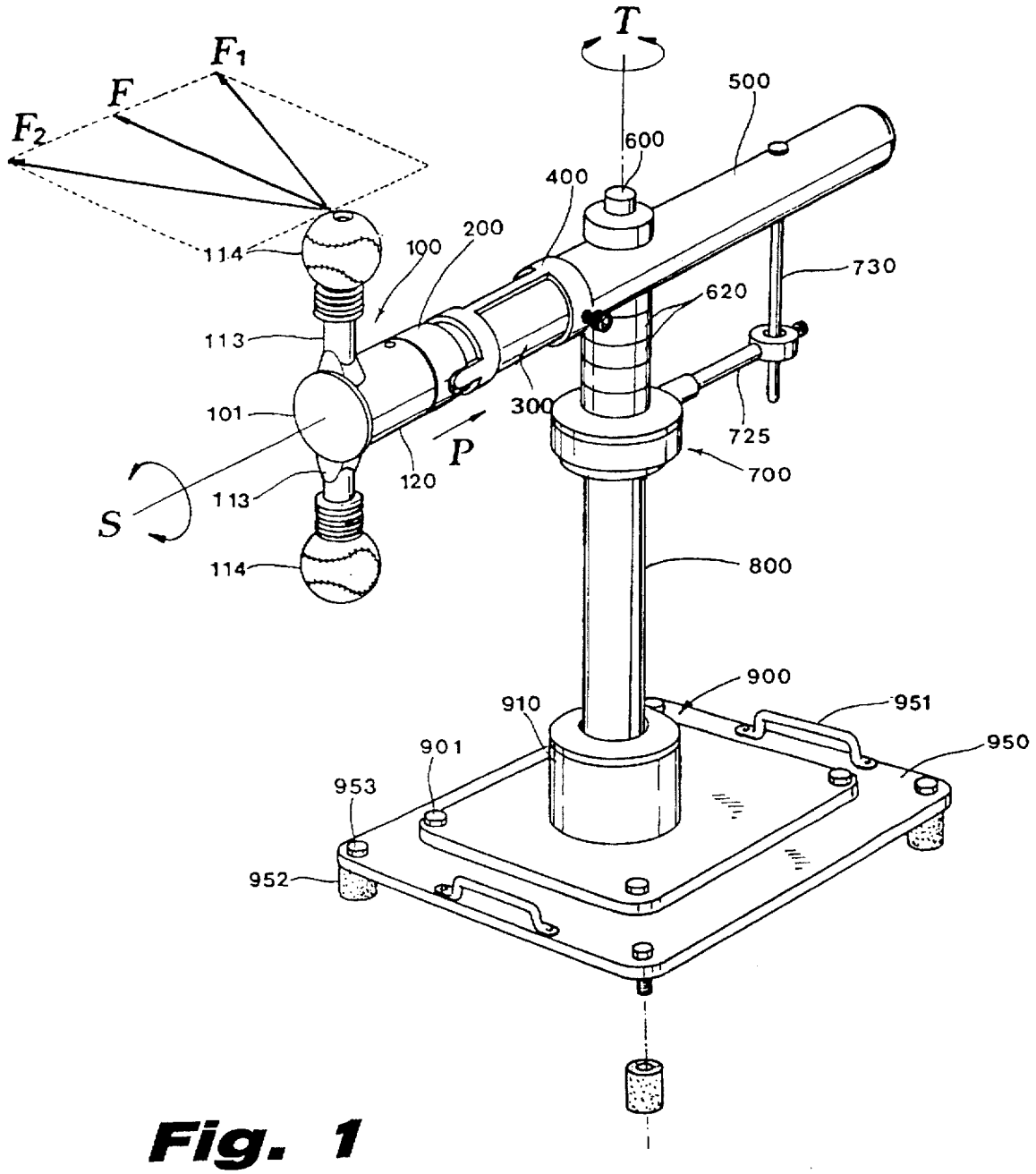
FIG. 1 is a perspective view illustrating the operating direction of some main components related with a batting trace when practicing with using the batting practice machine.
Figure 2:
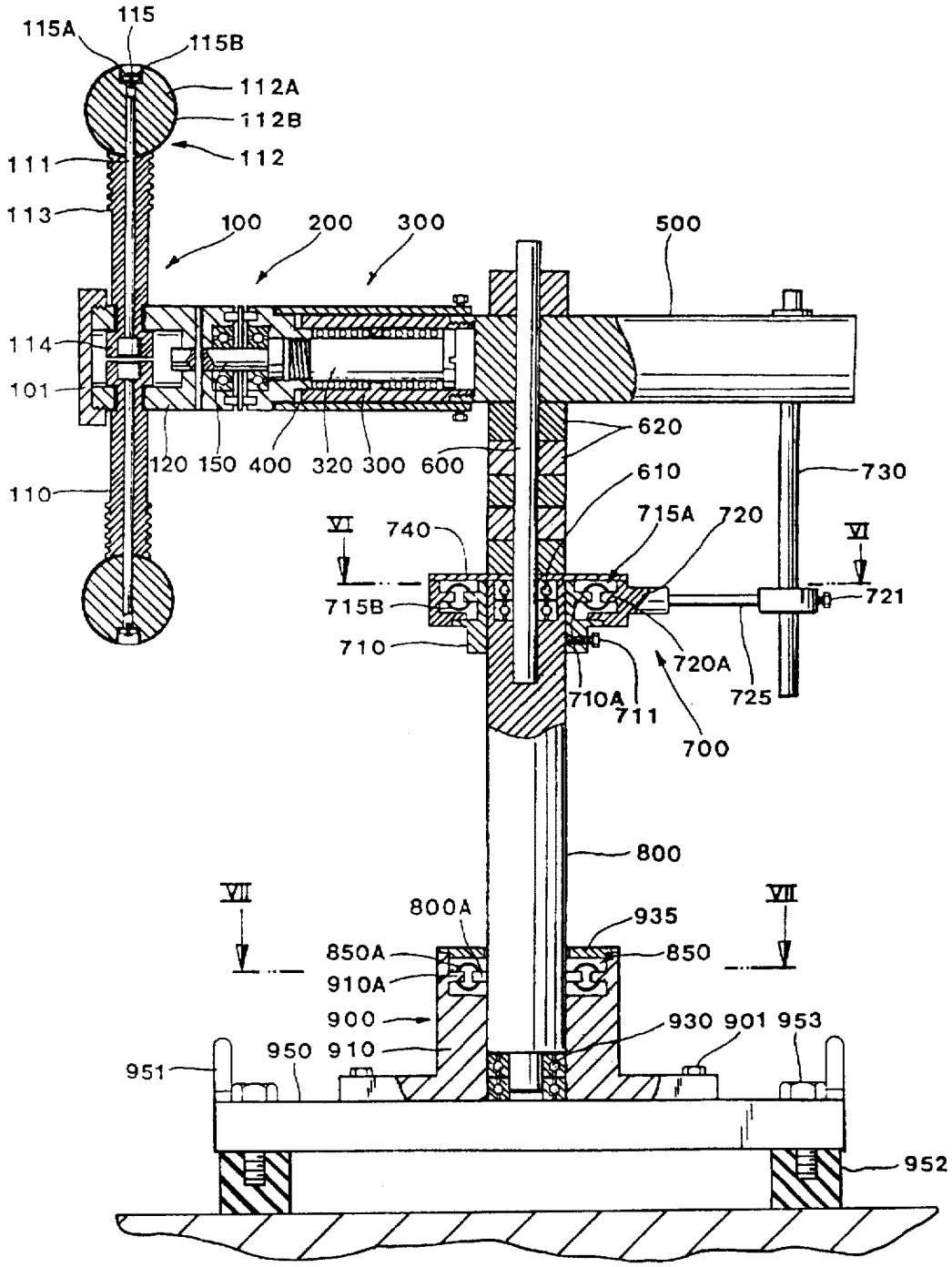
FIG. 2 is a side sectional view illustrating the whole construction of the batting practice machine according to the present invention.
Figure 3:
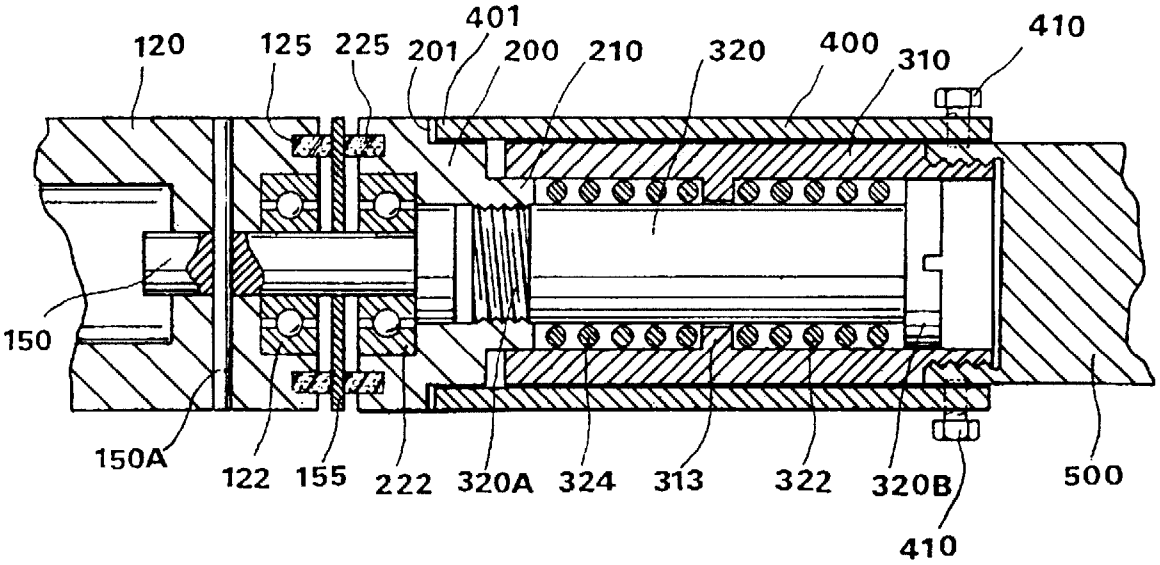
FIG. 3 is a detailed view of a damping member providing to a transverse pivot shaft according to the present invention.

FIG. 1 is a perspective view illustrating the moving direction of the main components related with a batting trace when practicing with the batting practice machine for baseball according to the present invention, FIG. 2 is a side sectional view illustrating the construction of FIG. 1, and FIG. 3 is a detailed view of the damping member which is provided to a transverse pivot shaft. As will be seen in the accompanying figures, the present invention comprises a vertical rotating body 100, a movable cylinder 200, a damping member 300, an anti-rotation rider 400, a transverse rotating shaft 500, an upper post 600, a first restoring member 700, a lower post 800, and a post supporting body 900 fixed to a base 950.

A number of legs 952 for damping impact are engaged to the base 950 by bolts 953, and handles 951 are provided to both upper sides of the base in order to easily carry the present machine. On the center of the upper surface of the base the post supporting body 900 is engaged by bolts 901. And, one recess is formed on the center of the upper surface of the post supporting body 900, into which the lower end of the lower post 800 is inserted and supported, and another recess into which the lower end of the upper post 600 is inserted is formed on the upper surface of the lower post 800. The connection of the upper and lower posts 600 and 800 is provided with a bearing 610, causing the upper post 600 to be rotatable around the lower post 800.

The transverse pivot shaft 500 is rotatable with the upper post 600 by connecting a portion of the shaft 500 with the upper portion of the upper post 600, with the portion being vertically penetrating through the upper post. Some hollow blocks 620 for regulating the height are laid on the outer side of the upper post 600 from the upper end of the lower post 800, and the transverse pivot shaft 500 is inserted into the upper most end of the laid block 620 and supported, such that by the regulation of the number of the laid blocks 620 the height of the transverse pivot shaft 500 can be regulated.

In order to resiliently return the transverse pivot shaft 500 and the upper post 600 to their initial positions the first restoring member 700 connects the transverse pivot shaft 500 with the lower post 800. Such first restoring member 700 comprises a fixing plate 710, a rotating plate 720, a restoring force transferring bar 730, and a pair of coil springs 715A and 715B. As in detail shown in FIGS. 5 and 6, the flange 712 of the fixing plate 710 is fixed to the circumference of the lower post 800 by the bolt 711 and has a pair of bosses 710A formed on the opposite position of the upper side of the flange 712.

Rotating plate 720 is positioned on the flange 712 in order to form a doughnut-shaped space along the circumference of the fixing plate 710. The rotating plate 720 has in position bosses 720A corresponding to the bosses 710A of the fixing plate 710 and on the outer surface a supporting rod 725 extending to the exterior. Between the fixing plate 710 and the rotating plate 720 the pair of coil springs 715A and 715B are arranged in the shape of semi-circle, which the both ends of the springs are supported by the bosses 710A and 720A, respectively. By the pair of coil springs 715A and 715B the rotating angle of the rotating plate 720 is restricted, and the rotated plate 720 can be returned to the initial position. And, the upper potions of the fixing plate 710 and the rotating plate 720 are shielded by a cover 740, such that the pair of coil springs 715A and 715B can be prevented from departing upwards.

The restoring force transferring rod 730 is engaged its lower end with the end of the supporting rod 725 by the bolt 721 and is engaged on its upper end to the transverse pivot shaft 500. When the transverse pivot shaft 500 rotates, the restoring bar 730 and the rotating plate 720 rotate, with the pair of coil springs 715A and 715B being compressed. When the rotating force of the transverse pivot shaft 500 is released, the rotating plate 720 is returned to the initial position by the restoring force of the pair of coil springs 715A and 715B, such that the transferring bar 730 and the transverse pivot shaft 500 can be returned to the initial position.

Also, the post supporting body 900 is provided with a second restoring member (not shown) so that when the transverse pivot shaft 500 is rotated with strong force the force is dispersed and absorbed by the first and second restoring members.

Figure 5:
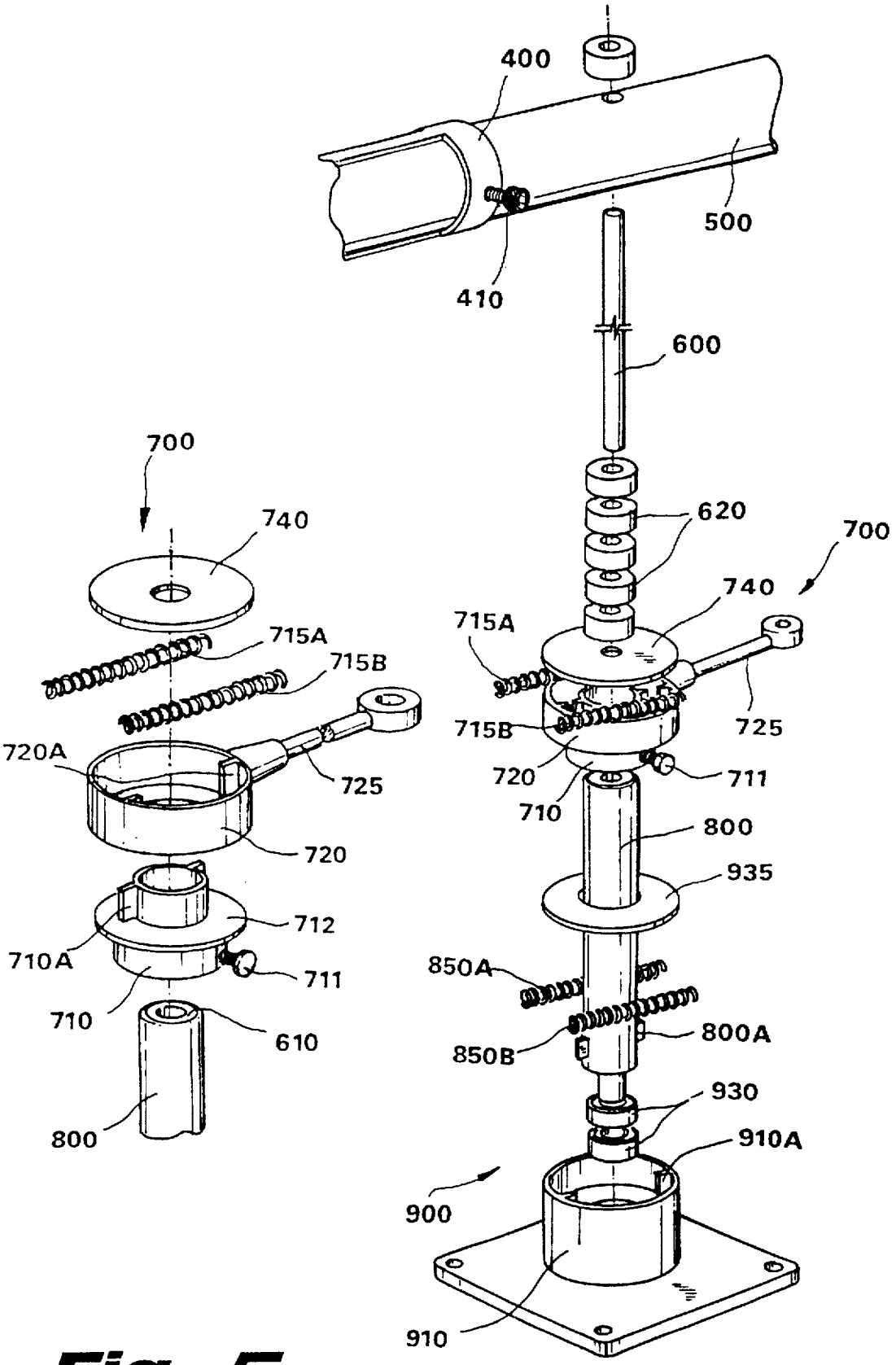
FIG. 5 is an exploded view illustrating the connection of the upper and lower posts of the batting practice machine according to the present invention.
Figure 6:
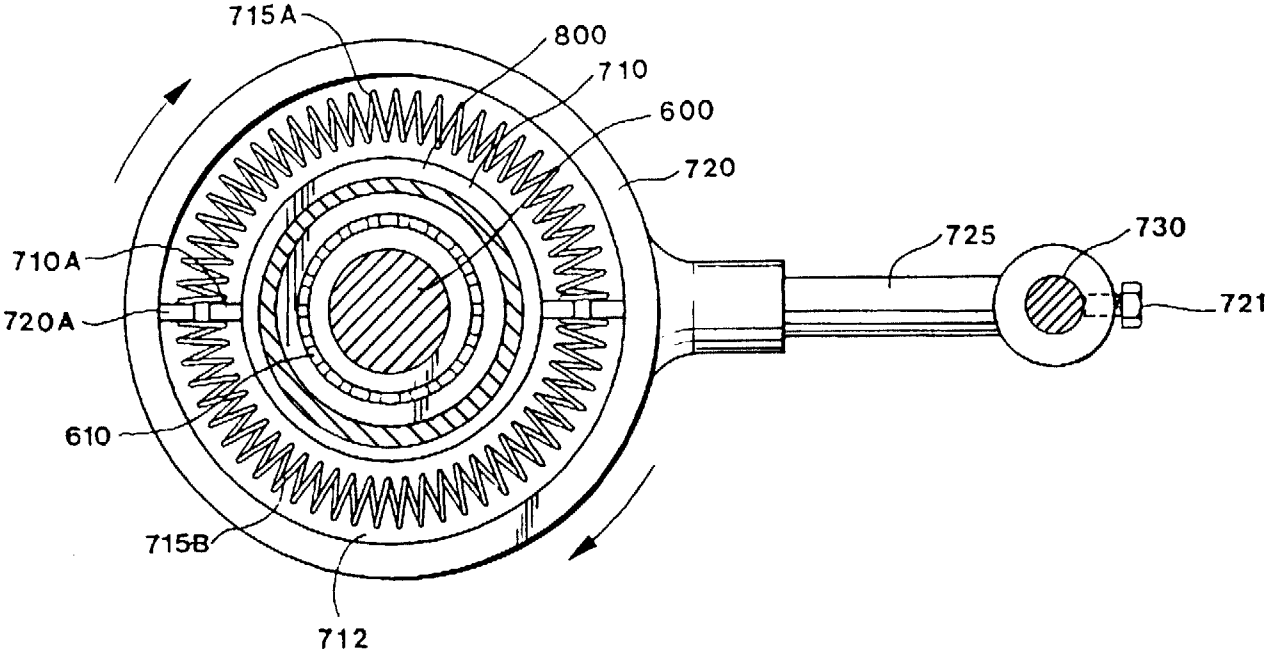
FIG. 6 is a sectional view of line VI—VI in FIG. 2.
Figure 7:
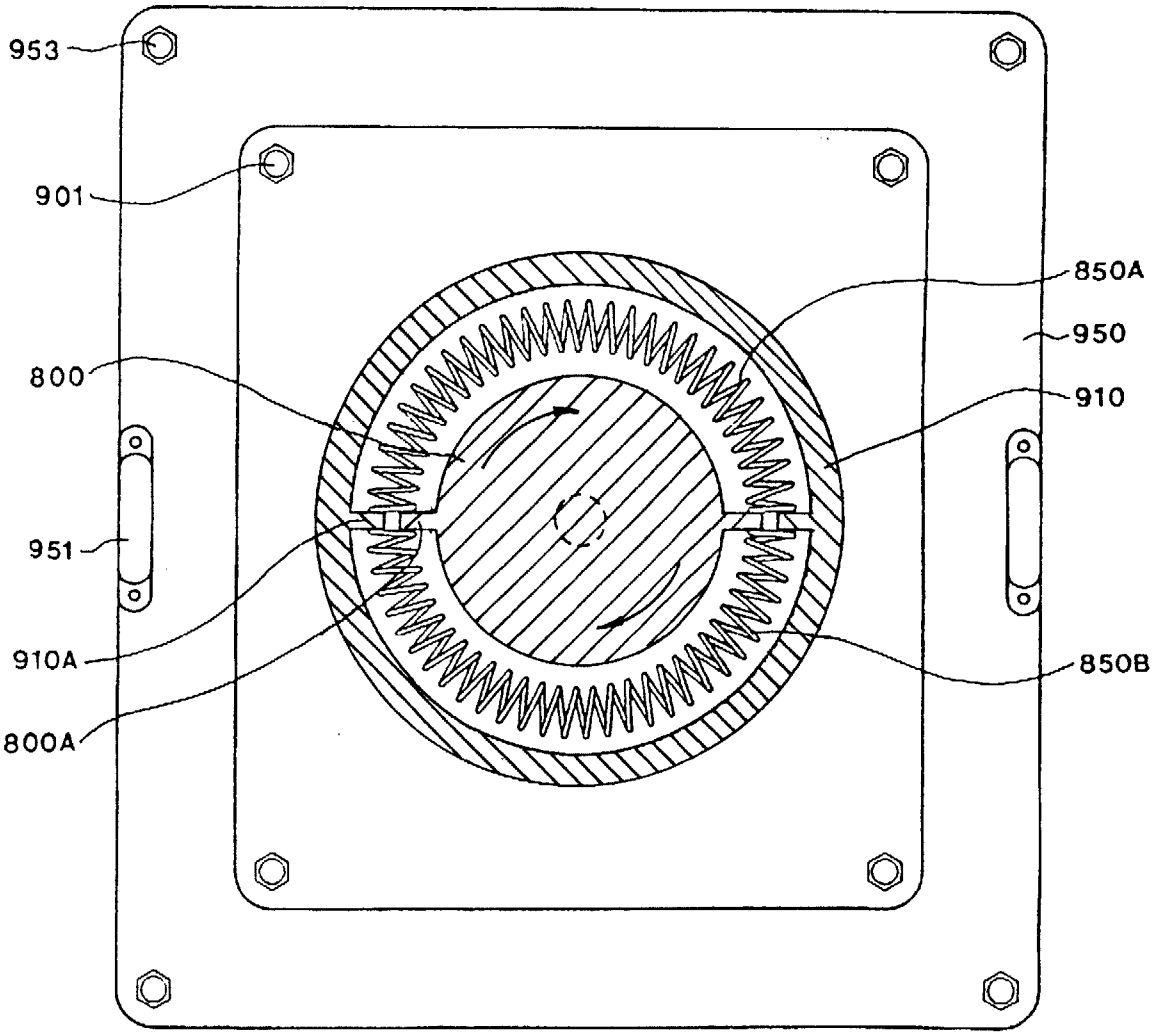
FIG. 7 is a sectional view of line VII—VII in FIG. 2.
Figure 8:
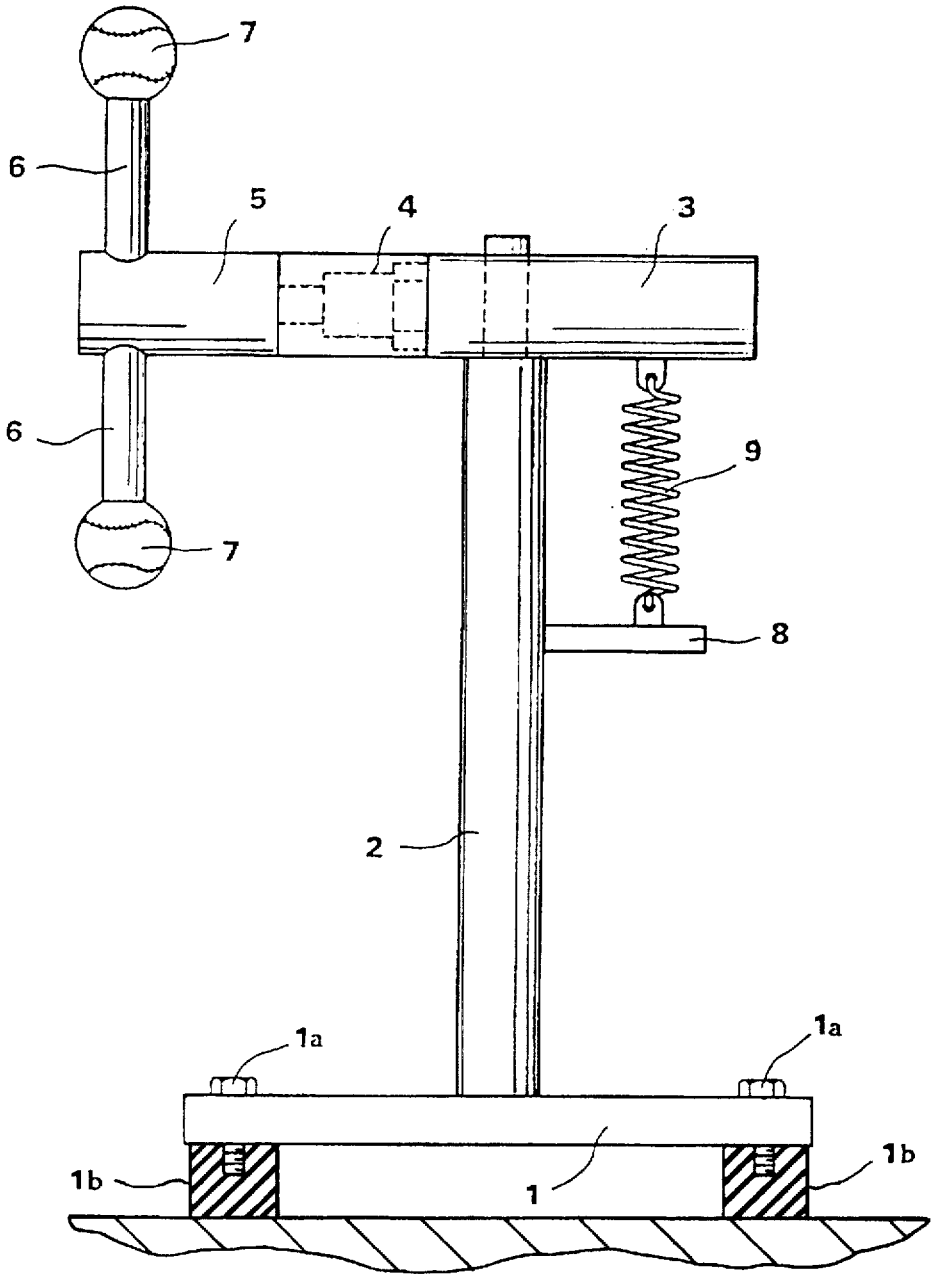
FIG. 8 is a side sectional view illustrating a prior art batting practice machine for baseball.

Such second restoring member, as in detail shown in FIGS. 5 and 7, comprises an elongate wall 910, a pair of coil springs 850A and 850B, and bosses 800A formed in the lower end of the lower post 800. The upper end of the post supporting body 900 is provided with the elongate wall 910 maintaining at a constant intervals with the outer surface of the lower post 800. The lower portion of the connecting surface of the lower post 800 and the elongate wall 910 which are arranged within the elongate wall 910 is provided with a bearing 930, such that the lower post 800 is rotatable arranged in the elongate wall 910. A pair of opposite bosses 910A are formed in the inner upper portion of the elongate wall 910, and also a pair of bosses 800A are formed on the outer surface of the lower post 800 opposite to the pair of bosses 910A. Between the pair of bosses 800A of the lower post 800 and the pair of bosses 910A of the elongate wall 910, a pair of coil springs 850A and 850B are provided in the shape of semi-circle, with each end of the coil springs 850A and 850B abutting against each of bosses 800A and 910A and supported by them. In order to prevent the coil springs from departing, the upper end of the elongate wall 910 is shielded by a cover 935. And thus, when the lower post 800 is rotated by the external force, each of the coil springs 850A and 850B is compressed in the direction of one side between the bosses 910A being in stop position and the bosses 800A being in rotating position. Upon releasing the external force by which the lower post 800 is rotated, the coil springs 850A and 850B are restored, and simultaneously, the lower post 800 is returned to the initial position.

Figure 4:
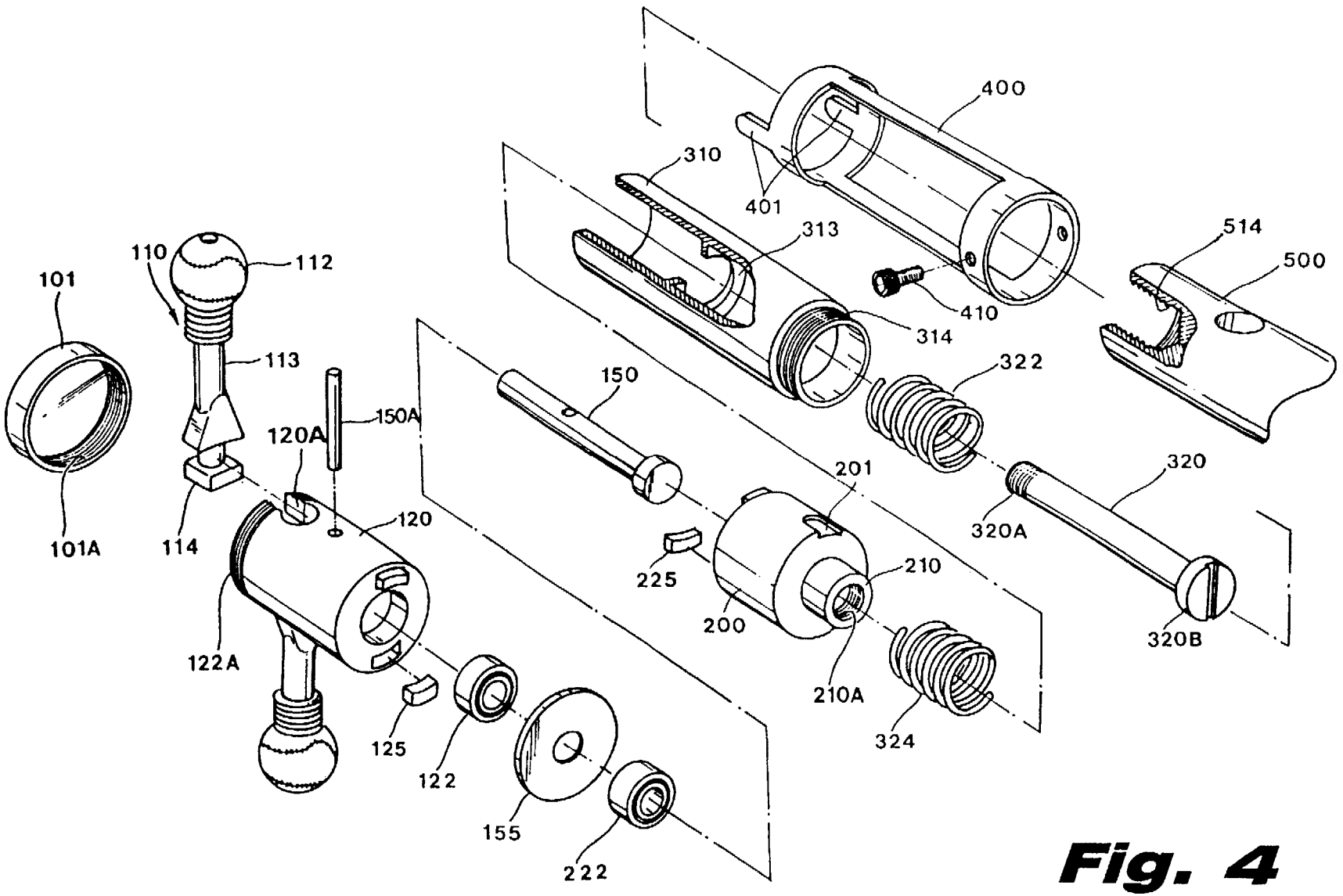
FIG. 4 is an exploded view of an upper rotating body of the batting practice machine according to the present invention.

The damping member 300, as shown in FIGS. 3 and 4, comprises a securing pipe 310 provided on the front end of the transverse pivot shaft 500, a pair of coil springs 322 and 324 and a damping pin 320 arranged in the securing pipe 310. The securing pipe 310 is a hollow pipe provided with a central projection 313 projecting from the inner center portion and is engaged with the transverse pivot shaft 500 by fastening screwed portions 314 and 514. In the securing pipe 310 the pair of coil springs 322 and 324 are engaged with each other on the both sides of the central projection 313, and the damping pin. 320 is inserted into the coil spring 322 and then the coil spring 324.

In other words, the head 320B of the damping pin 320 abuts against the outer end of the coil spring 322, and the lower portion of the damping pin 320 is threaded into the projection 210 of the movable pipe 200 by threading the screw portions 210A and 320A. By threading the damping pin 320 into the projection 210, each end of the coil springs 322 and 324 is closely contacted with both ends of the central projection 313, the head 320B and the projection 210, and simultaneously, the movable pipe 200 moves slidable within the securing pipe 310. And thus, where the movable pipe 200 is pressed toward and/or from the securing pipe 310 by the external force, the movable pipe 200 is compressed and/or expanded together with the damping pin 320. When the coil springs 322 and 324 are selectively compressed and then absorbed the external force to be applied, and when the external force applied to the movable pipe 200 is released, the movable pipe 200 is returned to the initial position by the restoring force of coil springs 322 and 324.

The anti-rotation rider 400 serves as a member in order to restrain the movable pipe 200 from rotating, one end of the rider being fixed to the transverse shaft 500 by bolts 410 and the other end inserted to the movable pipe 200. In particular, an anti-rotation recess 201 is formed on the rear outer surface of the movable pipe 200, and a rotation-restraining projection 401 protruding from the other end of the anti-rotation rider 400 is inserted and engaged to the recess 201. And thus, the movable pipe 200 is installed in such a way that the movable pipe 200 can be slidable toward and from the securing pipe 310 but be prevented from rotating itself.

The front end of the movable pipe 200 is rotatable engaged with the front end rotating body 100 which has a rotating pipe 120 and a pair of ball support 110. In particular, bearings 122 and 222 are installed on the inner surfaces of the rotating pipe 120 and the movable pipe 200, respectively, and a pair of permanent magnets 125 and 225 are mounted on the upper and lower portions of the inner surfaces, respectively, so that the permanent magnets 125 and the permanent magnets 225 will be arranged to attract each other. And, the rotating shaft 150 is journalled to the rotating pipe 120 by means of each of the bearings 122 and 222 and secured to the rotating pipe 120 with the securing pin 150A penetrating through the rotating pipe 120. A plate 155 for regulating the magnetic force is journalled on the rotating pipe 150 between the permanent magnets 125 and 225, so that both sides of the regulating plate 155 are faced with the rotating pipe 120 and the movable pipe 200, respectively.

With this arrangement, the rotating pipe 120 is always maintained in constant position on the basis of the movable pipe 200 by means of the permanent magnets 125 and 225. In case that the rotating pipe 120 is rotated by the external force stronger than the magnetic attraction between the permanent magnets 125 and 225, the rotating pipe 120 stops at the just half rotating position by the attraction between the permanent magnets 125 and 225 which one pair of magnets are positioned opposite to the other pair of magnets in the upper and lower positions.

The ball support 110 comprises a securing rod 113, a ball 112 connected to the upper end of the rod 113, and a locking protrusion 114 provided to the lower end of the rod 113. In particular, as shown in FIG. 2, the securing rod 113 penetrates through the ball 112 and secured thereto by a connecting pin 111. One end of the connecting pin 111 is secured to the inside of the locking protrusion 114 by means of a stepping portion thereof, and the other end is penetrated through the ball 112 and is engaged with a bolt 115 by way of an washer 115A and a rubber packing 115B, thereby securing the upper end of the securing rod 113 to the ball 112. Preferably, the securing rod 113 is made of a metal having a good impact resistant material, but various material such as FRP and the like may be used, if desired strength can be obtained. And, the ball 112 may be used a common ball which the surface of a rubber core 112A is covered with a leather cover 112B or a molded sphere having a high elasticity.

The pair of securing rods 113 to which the balls 112 are engaged as described above are secured to the rotating pipe 120. In particular, a pair of guide recesses 120A are formed on one end of the rotating pipe 120 to engage with a locking protrusion 114, which the pair of recesses 120A are opened from the front end. With the upper and lower securing rods 113 being inserted and engaged to the pair of guide recesses 120A, the upper and lower securing rods 113 are secured to the opposite ends of the rotating pipe 120 by threading the screw portion 101A of a cap 101 into the screw portion 122A formed on the circumference of the front end of the rotating pipe 120.

The operation of the main components and its operating advantages related with the batting practice using of the machine of the present invention as constructed above will be explained with reference to FIGS. 1, 2 and 3.

The present machine is restricted to rotate by the magnetic attraction of the upper and lower permanent magnets 125 of the front rotating body 100 and the upper and lower permanent magnet 225 of the movable pipe 200, with the above magnets 125 and 225 being arranged in opposite to each other and the magnetic force regulating plate 155 being interposed between the magnets, unless the ball 112 is hit. The ball support 110 is maintained and secured in the desired state (preferably, in the vertical state).

In the above state, when a hitter hits the ball 112 retained on the upper securing rod 113 in the straight direction of an arrow F, the upper securing rod 113 rotates the rotating pipe 120 and the rotating shaft 150 on the center of the movable pipe 200 in the direction of an arrow S. When the front rotating body 100 is rotated by batting, the movable pipe 200 does not rotate by means of the engagement of the rotating preventing recess 201 and the rotating restrain projection 401, and the only front rotating body 100 rotates which is journalled with the bearings 122 and 222 along the movable pipe 200 and the rotating shaft 150. At this time, the upper and lower permanent magnets 225 of the movable pipe 200 are maintained in securing state, and the position of upper and lower permanent magnets 125 of the front rotating body 100 is reversed. In other words, it is restrained the reversed upper and lower permanent magnets 125 of the front rotating body 100 from further rotating by the upper and lower permanent magnet 225 of the secured movable pipe 200, and thus the ball 112 engaged to the lower securing rod 113 is rapidly positioned on the peak point capable of batting it.

Also, when the rotating vibration may be happened in the transverse pivot shaft 500 around the upper post 600 by batting, the transverse pivot shaft 500 rotates by constant rotating angle in the opposite direction of an arrow T around the upper post 600 by the first restoring member 700. At this time, depending on rotating movement of the rotating plate 720 relative to the hitting strength of ball, to which the restoring transferring bar 730 and the supporting rod 725 are engaged at the rear side of the transverse pivot shaft 500, the pair of coil springs 715A and 715B which are divided-arranged between the rotating plate 720 and the securing plate 710 are compressed by the bosses 710A and 720A. Resisting force due to the compression of the coil springs 715A and 715B is transferred to the bat, when the hitter hits the ball 112. After hitting, the transverse pivot shaft 500 rotates in constant angle together with the ball 112 by the applied batting force. And then, the force applied to the ball 112 is reduced, and the restoring force by the coil springs 715A and 715B is strengthened such that according to the restoration of the coil springs 715A and 715B the transverse pivot shaft 500 is returned to its initial position.

If the rotating force of the ball 112 due to the hit is relatively strong and can not sufficiently absorbed by the first restoring member 700 only, the rest rotating force being not absorbed by the first restoring member 700 may be absorbed by rotating the lower post 800 by the rest rotating force through the second restoring member (not shown) installed on the post supporting body 900. In other words, the coil springs 850A and 850B interposed between the elongate wall 910 and the lower post 800 are compressed by bosses 800A and 910B, and rotates by the rest rotating force being not absorbed by the first restoring member 700. After the rotation is satisfactorily executed, the coil springs 715A and 715B and the coil springs 850A and 850B are returned to the initial positions, and the upper and lower posts 600 and 800 and the transverse pivot shaft 500 are rapidly and accurately returned to the initial positions capable of again hitting, so the hitter may practice repeatedly batting.

Although the operation of the batting practice for the common batting technique is described hereinbefore, the batting practice machine according to the present invention may provide other various practice.

That is, if the hitter hits the ball 112 retained on the upper securing rod 113 in close with the transverse pivot shaft 500 in push-hitting direction of an arrow F1, the front rotating body 100 is applied with the force pressing against the side direction P of the transverse pivot shaft 500. When such a pressing force is occurring, the projection 210 of the movable pipe 200 is inserted into the inner side of the securing pipe 310 and presses the coil spring 324. The pressing force of the direction P is absorbed by means of the pressed coil spring 324 which is compressed by the central projection 313 of the securing pipe 310, such that breakdown of the connection of the transverse pivot shaft 500 and the front rotating body 100 due to the impact may be prevented. And then, after the pressing force is released, the coil spring 324 is returned to the initial position, and the movable pipe 200 and the front rotating body 100 are returned to the position before compression. Accordingly, when the hitter hits in such a way of push-batting technique, the above damping function can be repeated.

Also, when the hitter hits the ball 112 retained on the upper securing rod 113 in the pull-batting direction F2 apart from the transverse pivot shaft 500, the front rotating body 100 is applied with pulling force in the opposite direction P of the transverse pivot shaft 500. At this time, depending on the front rotating body 100 and the damping pin 320 pulling in the direction of an arrow P, the coil spring 322 supported by the head 320B of the damping pin 320 is compressed, and then the transverse pivot shaft 500 absorbs the pulling force. After the above pulling force is released, the coil spring 322 is returned to its initial position, and then the transverse pivot shaft 500 may absorb the impact applied to the side. At this time, the anti-rotation recess 201 of the movable pipe 200 is restrictively moved in any range which the pipe 200 does not leave from the rotating restrain projection 401. And then, with the restoration of the coil spring 322, the front rotating body 100, the movable pipe 200 and the damping pin 320 are returned to the initial position before hitting, such that the above damming function can achieve repeatively if the hitter hits again pull-batting.

It will be understood that if a number of the blocks 620 which are inserted along the upper post 600 and support the transverse pivot shaft 500 may be changed, the height of the transverse pivot shaft 500 can be adjusted, such that because the height of the ball 112 can be adjusted the hitter may practice various desired batting technique such pull or push-batting on the suitable position proper to the condition of the user's body.

While the present invention has been described and illustrated herein with reference to the preferred embodiments thereof, it will be understood by those skilled in the art that various changes in form and details may be made therein without departing from the spirit and scope of the invention.

What is claimed is:

1. A batting practice machine comprising:

a post supporting body for supporting a lower post vertically mounted on an upper surface of a base;

an upper post rotatable mounted on an upper end of the lower post;

a transverse pivot shaft engaged to an upper portion of the upper post and rotatable with the upper post;

a first restoring means connecting the lower post to the transverse pivot shaft for returning the transverse pivot shaft rotated around the lower post to its initial position;

damping means provided to a front end of the transverse pivot shaft and therein having a damping pin with a pair of elastic means which is movably installed both sides of a center projection;

a movable pipe engaged to an end of the damping pin and therein having a rotating shaft journalled by a bearing, which a portion of the rotating shaft protruding forwardly;

a rotating restrain rider having one end secured to the transverse pivot shaft and the other end inserted to the movable pipe for restraining rotation of the movable pipe; and a front rotating body secured to the forward protruding portion of the rotating shaft and having on an outer front end a pair of ball supports.

2. The machine as claimed in claim 1, wherein the movable pipe and an engaging end of the front rotating body are provided with magnets, so that the front rotating body rotatable around the movable pipe is retained by magnetic attraction every half turn.

3. The machine as claimed in claim 1, wherein the transverse pivot shaft is supported on an upper end of a plurality of height adjusting block laying in the outer portion of the upper post.

4. The machine as claimed in claim 1, wherein the first restoring means comprises a securing plate mounted along a circumference of the lower post and having a pair of bosses formed on an upper outer surface of a flange; a rotating plate laying in the flange of the securing plate and having a pair of bosses opposite to the pair of bosses of the securing plate, a supporting rod protruding from an outer surface of the rotating plate; a restoring force transferring bar having both ends engaged to the transverse pivot shaft and the supporting rod, respectively; and a coil spring interposed between the bosses of the securing plate and rotating plate for restricting a rotating angle of the rotating plated and guiding restoration.

5. The machine as claimed in claim 1, wherein the post supporting body is provided with a second restoring means for compensating the restricted rotating angle of the first restoring means and enlarging the rotation angle.

6. The machine as claimed in claim 5, wherein the second means comprises an elongate wall provided to an upper portion of the post supporting body rotatable supporting the lower post, and having a pair of bosses formed on an inner surface of the elongate wall; a pair of bosses protruding from an upper portion of a connection surface of the lower post with the upper post body, opposite to the pair of bosses of the elongate wall; and a coil spring interposed between the opposite bosses.

* * * * *